US005117649A

United States Patent [19]

Mangini et al.

[11] Patent Number: 5,117,649

[45] Date of Patent: Jun. 2, 1992

[54] HORIZONTAL REFRIGERATOR

[75] Inventors: Daniel J. Mangini, Turnersville, N.J.; John P. Morris, Broomall, Pa.

[73] Assignee: Glenco-Star, Inc., Philadelphia, Pa.

[21] Appl. No.: 662,176

[22] Filed: Feb. 28, 1991

[51] Int. Cl.[5] ..... A47F 3/04

[52] U.S. Cl. ..... 62/251; 62/258; 62/458

[58] Field of Search ..... 62/246, 251, 258, 458

[56] References Cited

U.S. PATENT DOCUMENTS

| | | | |
|---|---|---|---|
| 2,555,425 | 6/1951 | Stern | 62/251 |
| 2,786,337 | 3/1957 | Spring | 62/458 X |
| 2,886,395 | 5/1959 | Cahn | 62/458 X |
| 4,685,311 | 8/1987 | Rastelli | 62/258 |
| 4,782,665 | 11/1988 | Wolfe | 62/246 |
| 4,802,340 | 2/1989 | Johnson | 62/258 X |
| 4,856,579 | 8/1989 | Wolfe | 62/458 X |

*Primary Examiner*—William E. Tapolcai, Jr.
*Attorney, Agent, or Firm*—Harness, Dickey & Pierce

[57] ABSTRACT

A food preparation table including a cabinet having a refrigerated base for cooling stored foods, and a refrigerated upper compartment wherein food pans are supported on a pan rail recessed vertically below the top surface of the unit whereby the refrigerator simultaneously maintains a blanket of cool air across the top of the food pan, which is lower than ambient temperature, and the food in the pan is maintained at its desired cooled temperature. An automatic hot gas defrost system prevents ice build-up which would otherwise lower optimum performance of the table.

12 Claims, 2 Drawing Sheets

HORIZONTAL REFRIGERATOR

This invention relates to self-contained countertop refrigeration units with a raised pan rail and in particular to an improved arrangement for maintaining a low temperature in a food pan mounted in the rail.

A self-contained food countertop refrigeration unit includes a thermally insulated stainless steel walled cabinet having a refrigerated product containing chamber and a refrigerated upwardly open compartment known as a "pan rail" for receiving one or more pans useful in dispensing food. The pans are refrigerated first by a fan forcing refrigerated air upwardly from a bottom food storage chamber of the cabinet so as to be circulated around the bottom and sides of the pans and second by thermal conduction between a series of refrigeration coils, compartment walls and sidewalls of the pan. As shown in FIG. 1, the refrigeration coils are bonded behind and to the interior walls and bottom wall of the pan rail and the food pan is mounted on the rail so as to be flush with the top horizontal surface of the cabinet. This dual mode arrangement of maintaining the food pan cool has been found to be satisfactory under existing food industry standards set by the National Sanitation Foundation (NSF) which require that the unit simultaneously maintain the temperature of food in the pan at 45° F. for prolonged periods with minimum dehydration and the storage chamber at 40° F. with a maximum compressor runtime of 70 percent in a 100° F. ambient.

NSF has recently changed the approved standard to a maximum product temperature of 40° F. which can occur in a warm environment such as found in a pizza restaurant. This concern has led to the establishment of a new standard that a refrigerated food preparation table be capable of taking a food product at 38° and maintaining it for a period of four hours between 33° F. and 40° F. in a room wherein the ambient temperature is 100° F. The above-mentioned food preparation table cannot always keep up with the product heat gain in such environment.

The primary object of this invention is provision of a horizontal self-contained counter-top height upwardly open food preparation table which achieves the above requirements as to control of temperature in a food pan.

In accordance with this invention there is provided a food preparation table including a refrigerator cabinet having a partition dividing the cabinet into a lower cooling chamber and an upper cooling chamber, a refrigeration system including refrigerant carrying coils operatively connected to a compressor, a condenser and an evaporator to refrigerate the cooling chambers. The upper cooling chamber comprises an elongated horizontal open top receptacle including elongated spaced front and back sidewalls, integral spaced endwalls, and an integral bottom floor defined by the partition. The front and back sidewalls each have, respectively, a horizontal ledge between upper and lower sidewall portions whereby to define a recessed rail for supporting the top rim of the pan between the top surface of the table and the bottom floor, and a lower interior space in the receptacle for receiving the body of the pan. Refrigerant coils adjacent the upper sidewall portions and uniquely located reduce the temperature of the air in the upper interior space of the receptacle to a temperature below ambient to assure that a cool thermal blanket extends across the top surface of the food pan to inhibit dehydration of the food. Refrigerant passing through the coils adjacent the lower sidewall portions conduct through the pan walls to maintain the food temperature at the desired level.

Advantageously, the recessed pan rail allows the unit to take advantage of the phenomena that hot dehydrating air above the receptacle will tend to rise and the denser cooling air will cling in the recess to the top of the food.

Further, the recessed pan eliminates the need for an air circulating fan and refrigeration relies entirely on refrigerant passed through evaporator coils.

The foregoing and other objects and advantages will become more apparent when viewed in light of the accompanying drawings and following detailed description of the invention in which.

Figure 1:
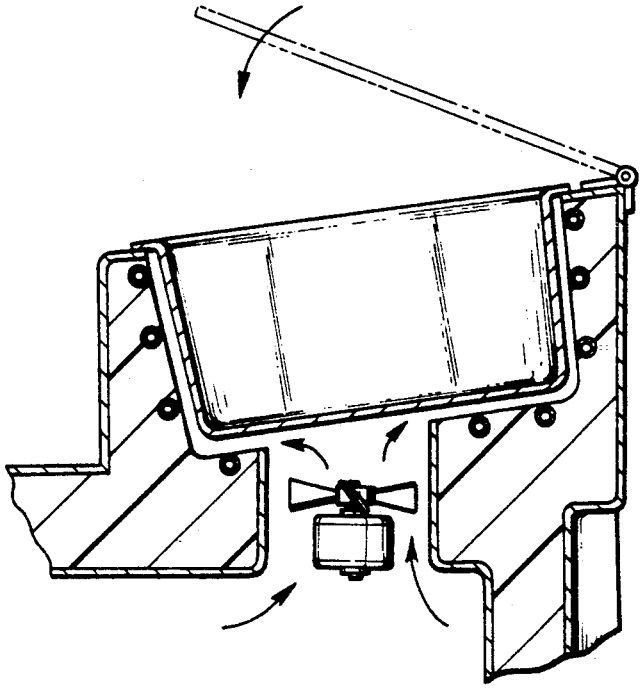
Fig-1 PRIOR ART
FIG. 1 is a section view of a prior art pan rail.
Figure 2:
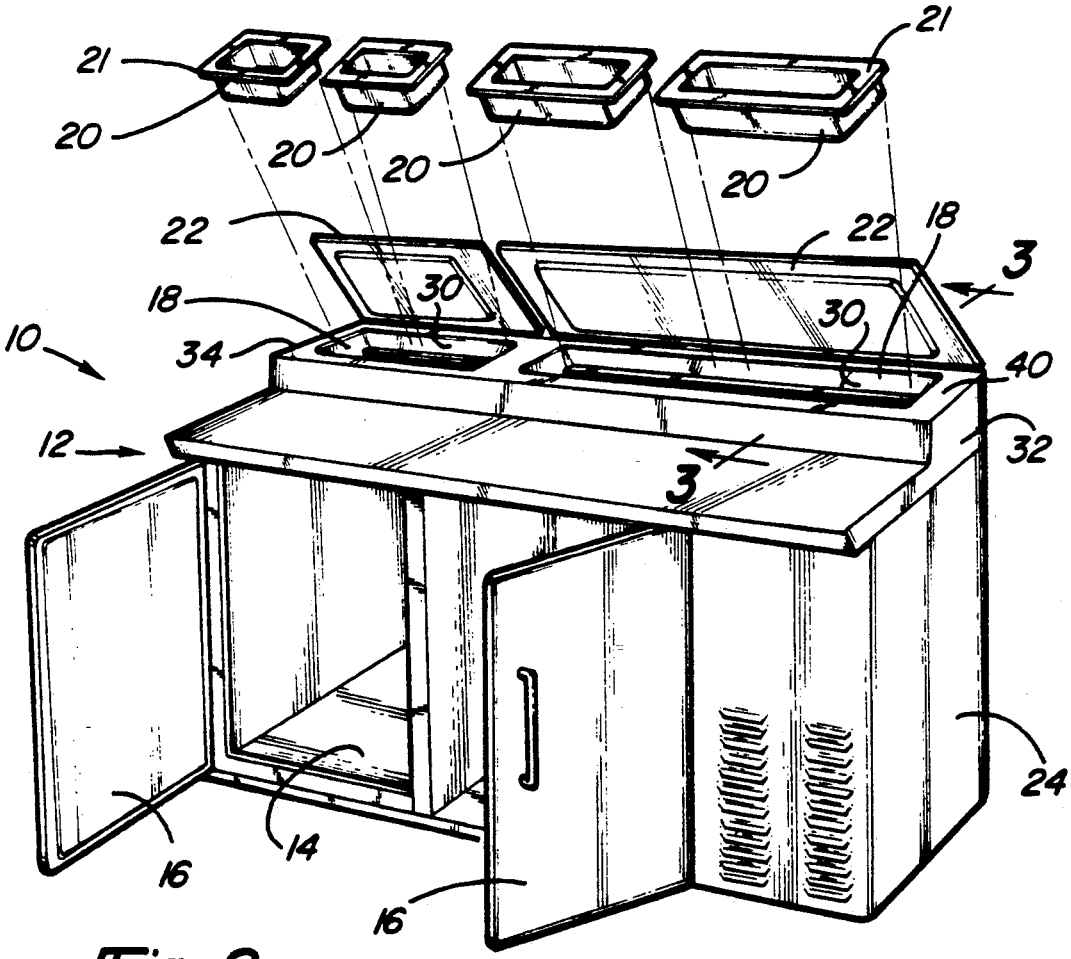
FIG. 2 is a perspective view of a self-contained food preparation table.
Figure 3:
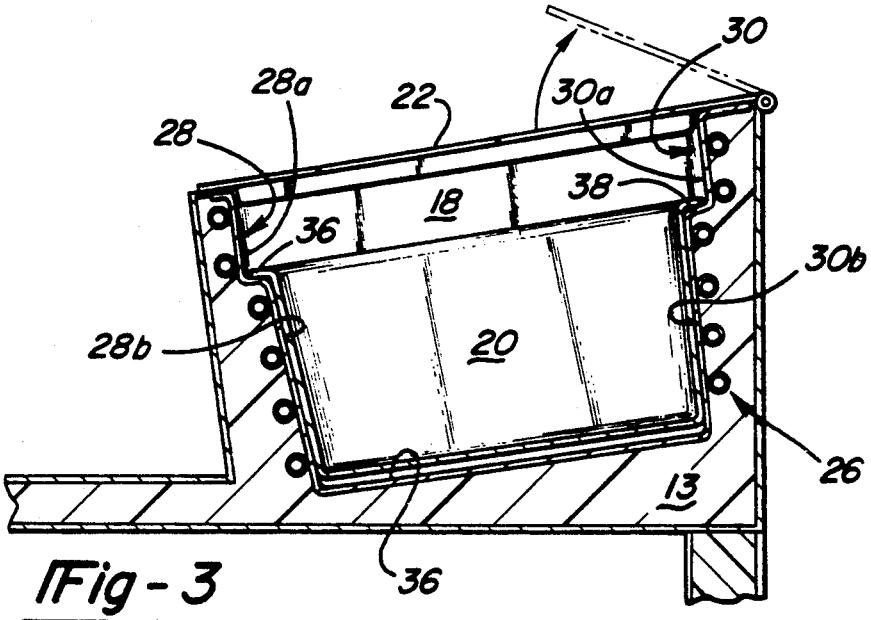
FIG. 3 is a section view taken along line 3—3 of the food preparation table of FIG. 2 showing a pan rail according to the present invention.
Figure 4:
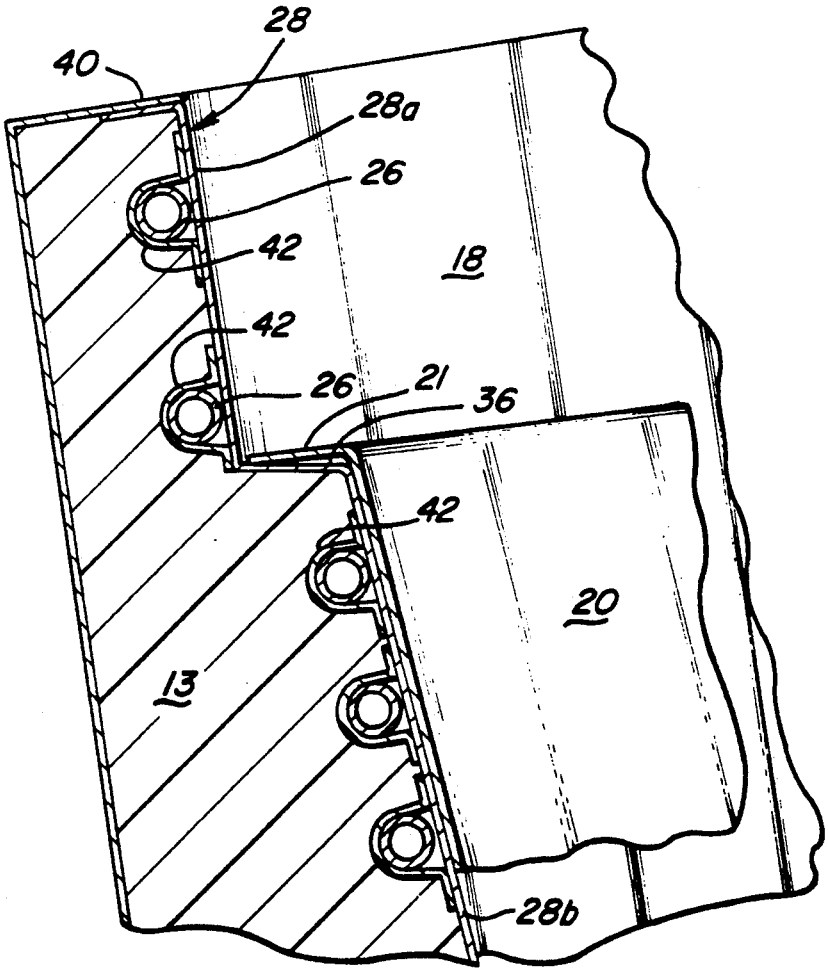
FIG. 4 is a detailed section view of the pan rail taken along line 4—4 of FIG. 3.

Turning now to the drawings, FIGS. 2–4 show a horizontal self-contained countertop height refrigerator table 10 which comprises an elongated generally rectangular base defining a cabinet 12 having a refrigerated chamber 14 for storing foods, and a pair of doors 16 for closing the chamber, and a pair of elongated upwardly open receptacles or compartments 18 for receiving food pans 20 useful in storing food to be dispensed and coverable by respective lids 22. A refrigeration system (not shown) includes a compressor and a condenser supported adjacent the base cabinet, an evaporator cabinet 24 supported adjacent the refrigeration system and having an evaporator (not shown), and copper tubing 26 for connecting the flow of refrigerant between the compressor, the condenser and the evaporator. Base cabinet 12 has thermally insulated wall preferably formed of spaced sheets of stainless steel and the area between the sheets being filled with a suitable thermally insulative material 13, such as polyurethane, foamed in place and about the refrigerant tubing.

Receptacle 18 is elongated generally horizontally extending, and includes elongated spaced front and back sidewalls 28 and 30, integral spaced endwalls 32 and 34, and an integral bottom floor 36 defining an interior space in the receptacle. Each of the respective sidewalls includes a horizontal ledge 36 and 38 between the open top surface 40 and bottom floor, the ledges dividing the respective sidewalls into a first wall portion **28*a* and 30*a* adjacent the open top, and a second wall portion 28*b* and 30*b* adjacent the bottom floor. The ledges are adapted to define a horizontal rail for supporting the rims 21 of one or more food pans 20 in lateral side-by-side relation and at a location vertically below horizontal surface 40. Preferably, the sidewalls 28 and 30 are at an angle of between 10 to 15 relative to a vertical and preferably at about 13° F., and bottom floor 36 is at an angle of about 8° to a horizontal, and acts to enable fluids to drain outwardly from the bottom of receptacle 18**.

Further, the refrigerant tubing 26 encircles the receptacle. As shown in FIGS. 3 and 4, the tubing associates two vertically separated coils, respectively, with the upper wall portions **28*a* and 30*a*, and four vertically separated coils, respectively, with the lower wall portions 28***b* and 30*b*. To enhance thermal conduction, the coils are intimately connected to the inner surface of the stainless steel sheet of each respective sidewall. As shown in FIG. 4, aluminum duct tape 42 can be utilized both to prevent foam 13 from becoming lodged between the copper tube where it makes a line contact with the stainless steel wall and to increase the area of the thermal conductive path.

The coils associated with the lower wall portions 28*b* and 30*b* operate to complete a thermal path between the refrigerant, the tubing 26, the sidewalls of the pan 20 and the refrigerator and act to maintain the food temperature at a preset temperature. The coils associated with the upper wall portions 28*a* and 30*a* operate to chill the air in the upper portion of the receptacle 18 whereby due to the fact that the cool air is more dense than warm air, will tend to form a thermal blanket or barrier of cold air across the top of the pan and the food therein, thereby inhibiting dehydration which could be caused by the warmer ambient air.

An arrangement for defrosting the cooling coils includes a sensor (not shown) which will operate at preset intervals to bleed hot gas into the compressor, whereby to inhibit ice build-up on the coils. An automatic hot gas defrost system prevents ice build-up which would otherwise lower optimum performance of the table.

Thus, there is disclosed in the above-description and in the drawings and embodiment of the invention which fully and effectively accomplishes the objects thereof. However, it will be apparent that variations in the details of the apparatus may be indulged in without departing from the invention herein described, or the scope of the appended claims.

What is claimed is:

1. In a horizontal, self-contained countertop height refrigerator of the type including a base cabinet having a storage chamber for cooling foods, and an elongated housing having a horizontally extending top surface exposed to ambient temperatures, said housing including an upwardly open receptacle for receiving a pan useful in storing rail means for supporting the pan in said receptacle at a predetermined distance vertically downwardly from said top surface and dividing the receptacle into an upper cooling chamber and a lower cooling chamber for receiving said pan, and refrigeration means for cooling said upper and lower chambers, said refrigeration means including a first and a second refrigerant carrying coil, respectively, thermally connected to said upper and lower chambers, said first coil operating to cool the air in said upper chamber below ambient and place a thermal barrier in covering relation vertically over the top of the food pan, and said second coil operating to cool the food in said pan disposed adjacent to and vertically below the rail means.

2. The invention as recited in claim 1 wherein said receptacle includes elongated spaced front and back sidewalls, integral spaced endwalls and an integral bottom floor defining a partition which divides the cooling chambers of the receptacle from the cooling chamber of the cabinet.

3. The invention as recited in claim 2 wherein said rail means comprises each of said front and back sidewalls having a horizontally extending ledge, said ledges being spaced vertically downwardly from said top surface and dividing said sidewalls into an upper wall portion extending between said top surface and said ledge and a lower wall portion extending between said ledge and said bottom floor.

4. The invention as recited in claim 3 wherein said refrigeration means comprises a first plurality of refrigerant coils encircling said upper wall portions and a second plurality of refrigerant coils encircling said lower wall portions.

5. The invention as recited in claim 3 wherein the upper and lower wall portions of each said sidewall are substantially parallel and the lower wall portions are dimensioned to be closely adjacent to the respective walls of the food pan.

6. The invention as recited in claim 4 wherein said front and back sidewalls comprise spaced sheets of stainless steel, one sheet of each respective pair of sheets having an outer surface and an inner surface, the outer surfaces facing one another and the inner surfaces facing the polymeric material, the space between the sheets being filled with a polymeric material, and means for securing said coils directly against the inner surfaces of said sheets.

7. A horizontal refrigerator comprising an upper first section having a top surface, a lower second section, wall means forming a separation between said sections, a plurality of laterally spaced compartments extending into said first section from said stop surface, each compartment including a vertically recessed rail to support a pan containing food to be kept in a refrigerated state, an upper portion forming a recessed air chamber between said top surface and said rail, and a lower portion below said rail and sized to receive said pan, first means for cooling the air in each said upper portion and maintaining the temperature above the pan below ambient, and second means for cooling the air in each said lower portion and maintaining the food in a refrigerated state when the pan is supported on the rail.

8. The invention as recited in claim 7 wherein said lower second section includes a chamber for maintaining food in a refrigerated state, and including a thermally insulated partition to prevent each of said chambers from communicating with one another, and connection means for connecting said first means with each of said chambers whereby to cool each of said chambers.

9. The invention as recited in claim 8, further including removable closure means for closing the compartments.

10. The invention as recited in claim 7 wherein said wall means forms a bottom wall in said compartment, and said compartment comprises a pair of laterally spaced end walls and a pair of elongated front and back walls extending between the respective end walls, each of said front and back walls having upper and lower wall portions and a ledge for supporting a food pan in the lower portion of said compartment.

11. A horizontal, self-contained countertop height refrigerated food preparation table, comprising a thermally insulated base cabinet having a product containing chamber, a thermally insulated horizontal refrigeration compartment for non-frozen foods to be prepared or dispensed, said compartment being upwardly open and having four generally vertically extensive walls and a floor the walls including vertically stepped and spaced front and back walls, the steps being adapted to divide the compartment into upper and lower spaces and form a horizontal rail for supporting a food containing pan below the opening, and refrigeration means for cooling said compartment and said chamber, said refrigeration means comprising a plurality of refrigerant carrying coils being thermally connected to the walls of said compartment, the coils being adapted to cool the lower space by conduction through the lower portion of the front and back walls whereby to cool and maintain the temperature of food in the pan, and cool the upper space by conduction through the upper portion of the front and back walls whereby to cool the air in the compartment such that said air in the upper space will be cooled and be at a temperature lower than the ambient temperature of the air surrounding the compartment and form a thermal insulating blanket over the food.

12. The invention as recited in claim 11, including a cover hinged to the back of the compartment to close the compartment.

* * * * *

UNITED STATES PATENT AND TRADEMARK OFFICE

CERTIFICATE OF CORRECTION

PATENT NO. : 5,117,649

DATED : June 2, 1992

INVENTOR(S) : Daniel J. Mangini et al.

It is certified that error appears in the above-identified patent and that said Letters Patent is hereby corrected as shown below:

Column 2, line 40,
"wall" should be --walls--.

Column 2, line 59,
"10 to 15" should be --10° to 15°--.

Column 3, line 41, claim 1,
After "storing", insert --foods to be dispersed to the public, the improvement comprising--.

Column 4, line 24, claim 7,
"stop" should be --top--.

Column 4, line 63, claim 11,
After "floor", insert --,--.

Signed and Sealed this

Twelfth Day of October, 1993

*Attest:*

Bruce Lehman

BRUCE LEHMAN

*Attesting Officer*

*Commissioner of Patents and Trademarks*